US005377991A

United States Patent [19]

Olsen

[11] Patent Number: 5,377,991

[45] Date of Patent: Jan. 3, 1995

[54] GAME METHOD AND APPARATUS

[76] Inventor: M. Ardell Olsen, 4305 Harrison Blvd., Suite 287, Ogden, Utah 84403

[21] Appl. No.: 221,872

[22] Filed: Apr. 1, 1994

[51] Int. Cl.[6] ..... A63F 3/00

[52] U.S. Cl. ..... 273/249

[58] Field of Search ..... 273/236, 242, 243, 248, 273/249, 251, 252, 254

[56] References Cited

U.S. PATENT DOCUMENTS

| | | | |
|---|---|---|---|
| 33,057 | 8/1900 | Pennell . | |
| 3,649,022 | 3/1972 | Clark, Jr. . | |
| 3,926,438 | 12/1975 | Breslow et al. . | |
| 3,984,106 | 10/1976 | White . | |
| 4,065,131 | 12/1977 | Martin, Jr. et al. | 273/243 |
| 4,121,823 | 10/1978 | McBride | 273/243 X |
| 4,157,183 | 6/1979 | Meyer et al. . | |
| 4,279,422 | 7/1981 | Shaw | 273/243 X |
| 4,368,889 | 1/1983 | Reker, Jr. | 273/243 |
| 4,557,485 | 12/1985 | Lardon | 273/249 X |
| 4,566,698 | 1/1986 | Sneden | 273/249 |
| 4,787,639 | 11/1988 | Ross | 273/249 |
| 5,042,816 | 8/1991 | Davis et al. | 273/243 |
| 5,048,842 | 9/1991 | Proctor . | |
| 5,224,862 | 7/1993 | Sullivan | 273/243 X |
| 5,259,623 | 11/1993 | Kanelos, Sr. | 273/243 X |

FOREIGN PATENT DOCUMENTS

| | | | |
|---|---|---|---|
| 3530487 | 3/1987 | Germany | 273/243 |
| 2183493 | 6/1987 | United Kingdom | 273/243 |
| 2215222 | 9/1989 | United Kingdom | 273/243 |

*Primary Examiner*—William E. Stoll

*Attorney, Agent, or Firm*—Thorpe, North & Western

[57] ABSTRACT

A game board is provided at least one player advancement track having a linear progression of advancement spaces. The game board also includes a circular movement track having a closed-loop progression of movement spaces extending in an unending, traversing configuration around the game board. A movement piece for each player is placed upon a beginning space of the circular movement track. A question is posed to each player in turn which, if answered correctly, entitles the player to select a random number and move his or her movement piece along the circular movement track a corresponding number of spaces. The game proceeds accordingly, wherein a player may move an advancement marker one space along the advancement track each time that player's movement piece lands upon one of a plurality of advancement-activating movement spaces. Some of the advancement-activating movement spaces are common to all participating players, while others operate to advance only the advancement marker of a particular player. The game is won by a player whose advancement marker first reaches a terminal position on the advancement track.

28 Claims, 3 Drawing Sheets

GAME METHOD AND APPARATUS

BACKGROUND OF THE INVENTION

1. Field of the Invention

The present invention relates generally to game boards and methods involving multiple movement tracks for each player of the game. More particularly, it concerns a trivia game wherein players respond to trivia questions which, if correctly answered, entitle a player to advance one or both of first and second movement pieces.

2. Background Art

Trivia games are known in the field of parlor games wherein questions are posed to players which, if answered correctly, entitle a player to advance toward a winning position. Trivia games have been developed to cover a broad range of subjects. Typical trivia playing format involves drawing a card which poses a trivia question and generating some form of player movement on a playing board provided the response to the question is correct. The game is typically won by a player whose movement piece has traversed a given player movement track. Differing categories of subject matter may be selected by random selection devices or by intentional choice of the player. The subject matter of such games generally entails historical information divided into categories such as sports, theater, national histories and other names, events and places having some historical significance.

A variety of elaborate movement tracks have been developed for game boards in various parlor games which include perimeter and interior movement tracks. For example, U.S. Pat. No. 3,649,022 (issued on Mar. 14, 1972 to Clark, Jr.) illustrates a game board having a variety of movement paths and playing positions which are randomly selected by throwing dice. Another embodiment of multiple movement tracks incorporated within a game board is shown in U.S. Pat. No. D33,057 (issued on Aug. 14, 1900 to Pennell). U.S. Pat. No. 3,984,106 (issued on Oct. 5, 1976 to White) teaches a player option of utilizing game cards or dice to control movement options of player pieces around a perimeter movement track. The option of instruction cards to dictate various actions during the playing of a game is shown in U.S. Pat. No. 3,926,438 (issued on Dec. 16, 1975 to Breslow et al.). A randomly actuated retrieving mechanism which operates to retrieve player pieces from a rotating platform is suggested in U.S. Pat. No. 4,157,183 (issued on Jun. 5, 1979 to Meyer et al. ). These games illustrate various game board structure combined with specific gaming sequences involving active play, but not necessarily in the field of trivia games.

A more elaborate game board structure was applied to the trivia game concept in U.S. Pat. No. 5,048,842 (issued on Sep. 17, 1991 to Proctor). The game board is divided into individual sectors for each player and includes a perimeter movement track whereon movement pieces are progressed. Each sector includes a player progress track having starting and terminal positions. Movement of a progress marker upon the player progress track is contingent upon a player giving a correct answer to a question. The player moves his or her progress marker a number of spaces corresponding to a number on a space of the perimeter movement track. Progress of the progress marker is thus contingent upon the number exhibited on the perimeter movement track and upon a player correctly answering a question.

Of current interest is a game board applied to the trivia game concept with an entirely new gaming sequence. Such a game is desired to include progress of a movement piece around a perimeter movement track being contingent upon a player correctly answering a question, and progress of an advancement marker being contingent upon the movement piece randomly landing upon certain movement spaces.

OBJECTS AND SUMMARY OF THE INVENTION

It is therefore an object of the present invention to provide a game including a game board having an advancement track used in conjunction with activity on a circular movement track.

It is another object of the present invention to provide such a game board wherein progress of a movement piece around a perimeter movement track is contingent upon a player correctly answering a question, and progress of an advancement marker is contingent upon the movement piece randomly landing upon certain movement spaces.

It is an additional object of the invention, in accordance with one aspect thereof, to provide such a game wherein a player's ability to recall information pertaining to the Book of Mormon is challenged.

The above objects and others not specifically recited are realized in a specific illustrative method for at least one player to play a game involving an exchange of questions and answers. A game board is provided including at least one player advancement track having a linear progression of advancement spaces. The game board also includes a circular movement track having a closed-loop linear progression of movement spaces extending in an unending, traversing configuration around the game board. A movement piece for each player is placed upon a beginning space of the circular movement track. A question is posed to each player in turn which, if answered correctly, entitles the player to select a random number and move his or her movement piece along the circular movement track a corresponding number of spaces. The game proceeds accordingly, wherein a player may move an advancement marker one space along the advancement track each time said player's movement piece lands upon one of a plurality of advancement-activating movement spaces. Some of the advancement-activating movement spaces are common to all participating players, while others operate to advance only the advancement marker of a particular player. The game is won by a player whose advancement marker first reaches a terminal position on the advancement track.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1A:
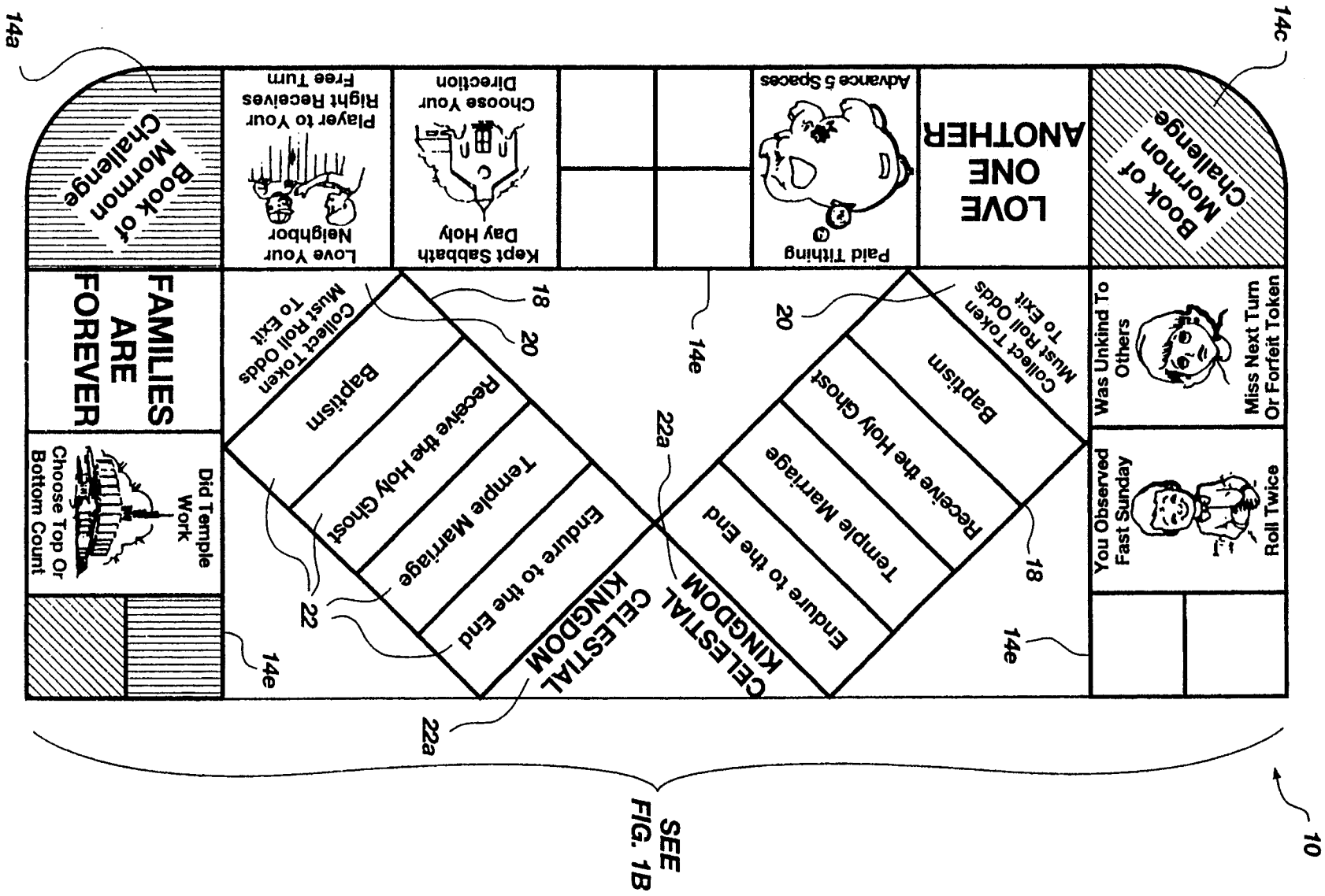
FIG. 1 illustrates a plan view of a game board configured in one embodiment of the present invention.

Reference will now be made to the drawings wherein like structures will be provided with like reference numerals.

Figure 1B:
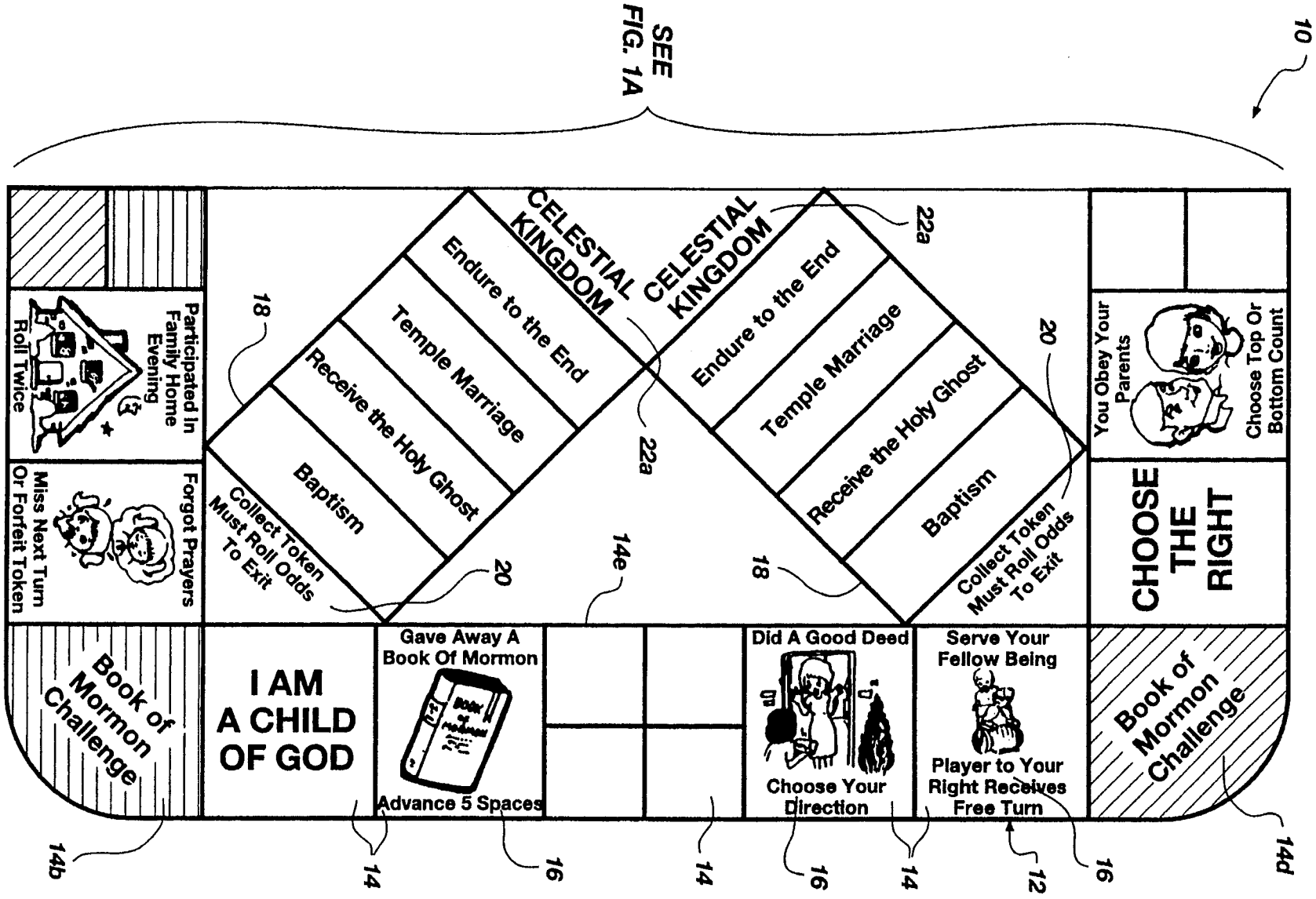
Figure 3:
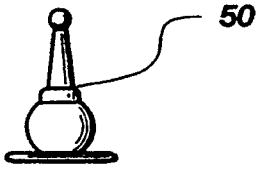
FIG. 3 illustrates a side view of a player movement piece for use in conjunction with the game board of FIG. 1.

FIG. 1 illustrates a preferred embodiment of a game board designated generally at 10. The game board 10 includes a circular movement track designated generally at 12 which includes a closed-loop linear progression of movement spaces 14 extending in an unending, traversing configuration around the game board 10. The term "circular" as used herein refers to the closed-loop path provided by the track 12 and not to a particular geometric configuration. Although the circular movement track 12 shown in FIG. 1 embodies a collection of the movement spaces 14 arranged in a substantially square shape, the arrangement could also be in the form of a circle, polyhedron or some other geometric form. The important feature is that the circular movement track 12 provides for random movement of a player movement piece 50 (FIG. 3) in recurring manner around the game board 10.

Most of the movement spaces 14 include written instructions 16 printed thereon instructing a player to perform a certain action if said player's movement piece 50 lands on the space. Only some of the movement spaces 14 and written instructions 16 shown in FIG. 1 are designated with the reference numerals 14 and 16. The game includes a plurality of player movement pieces 50, each of which bears a particular distinguishing color. Among the movement spaces 14 are individual beginning spaces 14*a–d*, each of which exhibits a distinctive color to correspond respectively with the distinguishing colors of the player movement pieces 50 for purposes of color coding. The beginning spaces 14*a–d* also function as individual advancement-activating spaces, as explained in more detail below.

The movement spaces 14 further include a plurality of common advancement-activating spaces 14*e*. Each common advancement-activating space 14*e* is divided into sectors which respectively exhibit the colors of the beginning/individual advancement-activating spaces 14*a–d*. Although only one of the common advancement-activating spaces 14*e* is illustrated with the various color coding of the spaces 14*a–d* in FIG. 1, it is to be understood that each of the four common advancement-activating spaces 14*e* shown would include the same array of colors. The significance of the color-coding sequence will be explained in more detail below.

Figure 2:
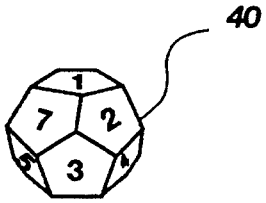
FIG. 2 illustrates a polyhedral die for use in conjunction with the game board of FIG. 1.
Figure 4:
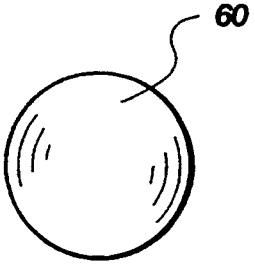
FIG. 4 illustrates a side view of a player advancement marker for use in conjunction with the game board of FIG. 1.
Figure 5:
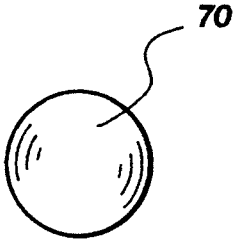
FIG. 5 illustrates a side view of a bonus token for use in conjunction with the game board of FIG. 1.
Figure 6:
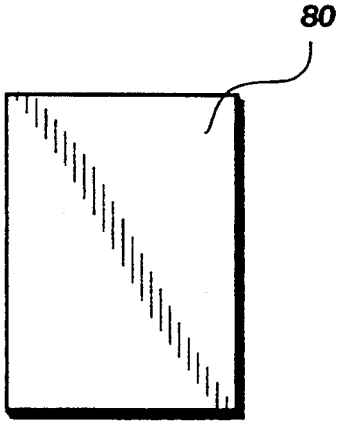
FIG. 6 illustrates a question and answer booklet for use in conjunction with the game board of FIG. 1.
Figure 7:
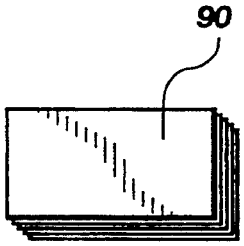
FIG. 7 illustrates a stack of chance cards for use in conjunction with the game board of FIG. 1.

The game board 10 further includes advancement tracks 18 and bonus areas 20. Each advancement track 18 is composed of a linear progression of advancement spaces 22 culminating in a final or terminal advancement space 22*a*. Only the advancement spaces 22 of one of the advancement tracks 18 are designated with the reference numeral 22. Additional contents to be used with the game board 10 include a polyhedral die 40 (FIG. 2), advancement markers 60 (FIG. 4), bonus tokens 70 (FIG. 5), a question and answer booklet 80 (FIG. 6), and chance cards 90 (FIG. 7). The question and answer booklet 80 contains questions and answers on given topics.

A game in accordance with the present invention is played as follows. The game board 10 shown in FIG. 1 is designed to accommodate up to four players, but may be modified to accommodate any number of players desired. Each player selects a movement piece 50 and places it on one of the beginning spaces 14*a–d* which corresponds to the color of said player's movement piece. A question is read to each player in turn from the question and answer booklet 80. Players who provide a correct answer to a question are entitled to toss the die 40. The player then advances his or her movement piece 50 clockwise along the circular movement track 12 a number of spaces 14 corresponding to the number shown on the top surface of the die 40. In other words, movement of a player's movement piece 50 along the circular movement track 12 is contingent upon compliance with a requirement directed to the player. It is to be understood that a requirement other than a question may be imposed upon the players which must be successfully accomplished to entitle a player to advance his or her movement piece 50. For example, the requirement may consist simply of tossing the die 40, especially where the players are young children who may not be sufficiently familiar with the questions presented by the question and answer booklet 80.

Advancement of a player's advancement marker 60 is random, and depends upon where the player's movement piece 50 lands. If a player's movement piece 50 lands upon either (i) the specific beginning/individual advancement-activating space 14*a–d* which exhibits a color corresponding to the movement piece 50, or (ii) one of the common advancement-activating spaces 14*e*, the player may place an advancement marker 60 on the first advancement space 22 (labeled "Baptism" in FIG. 1). The player advances the advancement marker 60 one space along the advancement track 18 toward the final or terminal advancement space 22*a* each subsequent time that the player's movement piece 50 lands upon said player's beginning space or one of the common advancement-activating spaces 14*e*. The game is won by a player whose advancement marker 60 first reaches the final or terminal advancement space 22*a* of said player's advancement track 18.

Each player is assigned an advancement track 18 which begins near said player's specific beginning space 14*a–d* for convenience and symmetry. One of the novelties of the present invention is thus that advancement of the advancement marker 60 is contingent upon a random landing position of a player's movement piece 50. The specific gaming sequence discovered by the present inventor thus includes two interrelated movement tracks, whereby progression of an advancement marker along one of the tracks is contingent upon random positioning of a movement piece along the other of the tracks. An additional novelty of the present invention is the inscription of various concepts in accordance with the LDS church on the advancement spaces 22, many of which are unique to the LDS church, including the following non-limiting examples: Baptism; Receive the Holy Ghost; Temple Marriage; Endure to the End; Celestial Kingdom.

It is to be understood that many alternative embodiments to those described herein are within the scope of the present invention. For example, the beginning spaces 14*a–d* and the common advancement-activating spaces 14*e* may exhibit corresponding symbols assigned to each player, instead of being color coded. Instead of separate advancement tracks 18 for each player, a single common advancement track could be utilized. Any method of selecting a random number may be substituted for the polyhedral die 40, such as a spinner, a set of square dice, or even a random-number-selecting computer, for example. Separate individual advancement-activating spaces could be included in the movement track 12 instead of the spaces 14*a–d* functioning as both beginning spaces and individual advancement-activating spaces. The question and answer booklet 80 may instead comprise some other configuration, such as a stack of cards, each card having a question on one side and the answer on the opposing side.

One purpose of the present invention is to teach information on a given subject. The inventor has chosen in the preferred embodiment to use the game to teach concepts of the Church of Jesus Christ of Latter-Day Saints (LDS church), sometimes referred to as the Mormon church because of that church's adherence to the Book of Mormon as a second witness of Jesus Christ in combination with the Bible. Accordingly, the game board 10 of FIG. 1 is referred to under the trademark Book of Mormon Challenge TM, and may alternatively be referred to as Book of Mormon Quest TM. The written instructions 16 on the movement spaces 14 pertain to the Book of Mormon and other aspects of the LDS church's practices and doctrine consistent with the inventor's purpose to teach these concepts. Further, the questions and answers contained in the booklet 80 pertain to the Book of Mormon. The phrase "Book of Mormon" as used herein thus refers to that volume of holy scripture proclaimed by the LDS church as a record of God's dealings with the ancient inhabitants of the Americas which was written by many ancient prophets upon gold plates, abridged by a prophet-historian named Mormon, and translated in the early 1800s by Joseph Smith, Jr., first published in 1830. It is to be understood, however, that the game board 10 and the instructions in the booklet 80 may pertain to any given subject or a plurality of subjects, such as Bible topics, American history, and/or any other subject.

The game may be modified and enhanced in the following ways. For example, a player must follow an instruction 16 printed on a movement space 14 said player's movement piece 50 has landed on. The instruction may contemplate any action, such as advancing the movement piece 50 along the circular movement track 12 a certain number of spaces, or singing a song. The song titles "Families Are Forever," "I Am A Child Of God," "Love One Another," and "Choose The Right" have been included on certain movement spaces 14 as shown in FIG. 1 to indicate the optional requirement that the player whose movement piece 50 lands upon one of those movement spaces 14 must then sing the corresponding song.

Other actions instructed by the instructions 16 include the following non-limiting examples: forgot prayers (or was unkind to others), miss the next turn or forfeit a token; participated in family home evening (or observed fast Sunday), roll twice; did temple work (or obeyed your parents), choose top or bottom count (of the die 40); did a good deed (or kept Sabbath Day Holy), choose your direction (of the movement piece 50 along the movement track 12); gave away a Book of Mormon (or paid tithing), advance five spaces; serve your fellow being (or love your neighbor), player to your right receives a free turn. It is to be understood that the present invention includes the option that some of the instructions 16 may be designated to be carried out as part of a player's following turn.

The game can also be enhanced with the use of the bonus tokens 70 in a number of ways, including the following non-limiting example. When a player's movement piece 50 lands upon any one of the colored beginning spaces 14*a–d*, the player has the option to move his or her movement piece to the adjacent bonus area 20 and be awarded a bonus token 70. On the player's following turn, the player must roll an odd number (or even) as indicated by the bonus area 20 in order to advance said player's movement piece 50. Note that, in the preferred embodiment of FIG. 1, two bonus areas 20 require an odd-numbered roll and the other two bonus areas 20 require an even-numbered roll. If the player fails to roll an odd number (or even) as required, said player's movement piece 50 is returned to the adjacent colored beginning space 14*a–d* but the player must miss that turn and resume action as usual on said player's following turn. Players may advance their advancement markers 60 one space toward the final or terminal advancement space 22*a* in exchange for two bonus tokens 70. If a player's movement piece 50 comes to rest on a movement space 14 exhibited the instruction of a missed turn penalty, that player may forfeit a bonus token 70 in place of the missed turn.

A further enhancement of the game involves optional use of the chance cards 90 of FIG. 7. If a player's movement piece 50 lands on one of the movement spaces 14 bearing song titles as discussed above, said player has the option to draw a chance card 90. Written instructions can be printed on the chance cards 90 to instruct a player to perform a certain action, such as the following non-limiting examples: take out the garbage; choose refreshments; write a letter; choose a favorite meal; invite a friend to sleep over; choose a video to watch; write in a diary; help clean a room; do a good deed. It is to be understood that any means for permitting a player to select a random instruction may be substituted for the chance cards 90, such as a separate booklet of instructions or even having opposing players spontaneously impose a requirement.

The present inventive concepts can be enhanced with the use of a device as known in the art. The game may be further modified by permitting players to selectively choose among a plurality of topics, or among specific topics within the Book of Mormon.

The present invention represents a significant advance in the field of trivia games. Applicant notes that a significant aspect of the present invention is the specific gaming sequence as applied to the separate movement track 12 and advancement tracks 18, whereby advancement of an advancement marker 50 along an advancement track 18 is contingent upon random positioning of the movement piece 50 on the movement track 14. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A method for at least one player to play a game with a game board having at least one player advancement track interrelated with a closed loop movement track, said advancement track comprising a linear progression of advancement spaces having beginning and terminal positions, and said closed loop movement track comprising a closed-loop linear progression of movement spaces extending in an unending, configuration around the game board, said method comprising the steps of:

(a) placing a movement piece for each player upon a beginning space of the closed loop movement track;

(b) imposing a requirement upon each player in turn which, if successfully accomplished, entitles that player to select a random number and move a movement piece along the movement track a number of spaces corresponding to said random number;

(c) moving an advancement marker of a particular player along the player advancement track toward the terminal position of said player advancement track each time that player's movement piece lands upon either (i) an individual advancement-activating space of the movement track assigned to that player, or (ii) a common advancement-activating space of the movement track common to all participating players, whereby the game is won by a player whose advancement marker first lands upon the terminal position of the player advancement track.

2. A method as defined in claim 1, further comprising the step of:

(d) instructing a particular player to perform an action in accordance with an instruction exhibited on an instructional movement space when that player's movement piece lands upon said instructional movement space.

3. A method as defined in claim 2, wherein the instruction defined in step (d) is selected from the group consisting of (A) advance the movement piece along the closed loop movement track a certain number of spaces and (B) sing a song.

4. A method as defined in claim 1, wherein the movement spaces of the closed loop movement path include a plurality of instructional movement spaces, said method further comprising the step of:

(e) moving a movement piece of a particular player along the movement track in accordance with instructions exhibited on one of the instructional movement spaces as part of a following turn when that player's movement piece lands upon said instructional movement space.

5. A method as defined in claim 4, wherein the instructions exhibited on at least one of said instructional movement spaces instruct that player to choose a direction of movement of that player's movement piece along the closed loop movement track during said following turn.

6. A method as defined in claim 5, wherein the instructions exhibited on at least one of said instructional movement spaces instruct that player to select a second random number as part of step (b) and move his or her movement piece along the movement track a number of spaces corresponding to said second random number.

7. A method as defined in claim 6, wherein the selection of a random number in accordance with step (b) comprises tossing at least one die and selecting a number exhibited upon a top surface of said die, and wherein the instructions exhibited on at least one of said instructional movement spaces instruct that player to choose between two numbers respectively exhibited upon top and bottom surfaces of said die as the random number selection portion of step (b).

8. A method as defined in claim 1, further comprising the step of:

(f) moving a movement piece of a second player along the movement track in accordance with instructions exhibited on a particular movement space when a first player's movement piece lands upon said movement space.

9. A method as defined in claim 8, wherein the instructions exhibited on a particular movement space permit a player to the first player's right to receive a free turn when that first player's movement piece lands upon said movement space.

10. A method as defined in claim 1, further comprising the steps of:

(g) moving a movement piece of a particular player into a bonus area on the game board and awarding a bonus token to that player when that player's movement piece lands upon a particular movement space;

(h) moving said movement piece back onto said particular movement space during that player's following turn;

(i) permitting that player to proceed in accordance with steps (b) and (c) provided the random number selected during step (b) is even or odd as required by an instructional requirement exhibited upon the bonus area, such that if said random number is not even or odd as required, said player is required to miss the turn and resume action as usual on a subsequent turn;

(j) permitting that player to selectively perform an action in exchange for at least one bonus token.

11. A method as defined in claim 10, wherein the action defined in step (j) is selected from the group consisting of (A) advancing that player's advancement marker along the player advancement track and (B) waiving a penalty to miss a turn.

12. A method as defined in claim 1, further comprising the step of:

(k) permitting a particular player to select a random instruction when that player's movement piece lands upon a certain movement space and requiring that player to perform an action in accordance with the instruction.

13. A method as defined in claim 12, wherein the instruction as defined in step (k) is selected from the group consisting of (A) take out garbage, (B) choose refreshments, (C) write a letter, (D) choose a favorite meal, (E) invite a friend to sleep over, (F) choose a video to watch, (G) write in a diary, (H) help clean a room, and (I) do a good deed.

14. A method as defined in claim 1, wherein the selection of a random number in accordance with step (b) comprises tossing at least one die and selecting a number exhibited upon a top surface of said die.

15. A method as defined in claim 14 wherein the selection of a random number in accordance with step (b) comprises tossing a polyhedral die having twelve sides.

16. A method as defined in claim 1 wherein step (b) further comprises posing a question to each player in turn wherein the requirement is successfully accomplished if the player provides a correct answer to the question.

17. A method as defined in claim 16 wherein the question is selected from a group of questions pertaining to the Book of Mormon.

18. A method of teaching information on a given subject to at least one person as part of an entertaining activity comprising a game board having at least one player advancement track interrelated with a closed loop movement track, said advancement track comprising a linear progression of advancement spaces and said closed loop movement track comprising a closed-loop progression of movement spaces extending in an unending, traversing configuration around the game board, the movement spaces of the closed loop movement path including a plurality of instructional movement spaces, said method comprising the steps of:

(a) placing a movement piece for each player upon an individual beginning space of the closed loop movement track assigned to that player;

(b) posing a question pertaining to the given subject to each player in turn which, if successfully answered, entitles that player to select a random number and move his or her movement piece along the movement track a number of spaces corresponding to said random number;

(c) moving a movement piece of a particular player along the movement track in accordance with an instruction exhibited on a first type of instructional movement space when that player's movement piece lands upon said first instructional movement space;

(d) moving a movement piece of a particular player along the movement track in accordance with an instruction exhibited on a second type of instructional movement space as part of a following turn when that player's movement piece lands upon said second instructional movement space;

(e) moving a movement piece of a second player along the movement track in accordance with an instruction exhibited on a third type of instructional movement space when a first player's movement piece lands upon said third instructional movement space;

(f) moving an advancement marker of a particular player along the player advancement track toward a terminal position of that player advancement track each time said player's movement piece lands upon either (i) an individual advancement-activating space of the movement track assigned to that player, or (ii) a common advancement-activating space of the movement track common to all participating players, whereby the game is won by a player whose advancement marker first lands upon the terminal position of the player advancement track;

(g) moving a movement piece of a particular player into a bonus area on the game board and awarding a bonus token to said player when that player's movement piece lands upon a particular movement space, and (i) moving said movement piece back onto said particular movement space during that player's following turn, and (ii) permitting that player to proceed in accordance with steps (b) through (f) provided the random number selected during step (b) is even or odd as required by an instructional requirement exhibited upon the bonus area, such that if said random number is not even or odd as required, that player is required to miss the turn and resume action as usual on a subsequent turn;

(h) permitting that player to selectively perform an action in exchange for at least one bonus token.

19. A method as defined in claim 18, wherein the instruction exhibited on the first type of instructional movement space as defined in step (c) is selected from the group consisting of (A) advance the movement piece along the closed loop movement track a certain number of spaces and (B) sing a song.

20. A method as defined in claim 18, wherein the instruction exhibited on the second type of instructional movement space as defined in step (d) instructs that player to choose a direction of movement of that player's movement piece along the closed loop movement track during said following turn.

21. A method as defined in claim 18, wherein the instruction exhibited on the second type of instructional movement space as defined in step (d) instructs said player to select a second random number as part of step (b) and move his or her movement piece along the movement track a number of spaces corresponding to said second random number.

22. A method as defined in claim 18, wherein the selection of a random number in accordance with step (b) comprises tossing a die and selecting a number exhibited upon a top surface of said die, and wherein the instruction exhibited on the second type of instructional movement space as defined in step (d) instructs that player to choose between two numbers respectively exhibited upon top and bottom surfaces of said die as the random number selection portion of step (b).

23. A method as defined in claim 18, wherein the instruction exhibited on the third type of instructional movement space as defined in step (e) instructs a player to the first player's right to receive a free turn when the first player's movement piece lands upon said movement space.

24. A method as defined in claim 18, wherein the action defined in step (h) is an action selected from the group consisting of (A) advancing that player's advancement token along the player advancement track and (B) waiving a penalty to miss a turn.

25. A method as defined in claim 18, further comprising the step of:

(i) permitting a particular player to select a random instruction when that player's movement piece lands upon a certain movement space and requiring that player to perform an action in accordance with the instruction.

26. A method as defined in claim 25, wherein the instruction as defined in step (i) is selected from the group consisting of (A) take out garbage, (B) choose refreshments, (C) write a letter, (D) choose a favorite meal, (E) invite a friend to sleep over, (F) choose a video to watch, (G) write in a diary, (H) help clean a room, and (I) do a good deed.

27. A method as defined in claim 18, wherein the selection of a random number in accordance with step (b) comprises tossing a die and selecting a number exhibited upon a top surface of said die.

28. A method as defined in claim 18 wherein the given subject as defined in step (b) pertains to the Book of Mormon.

* * * * *